US010635031B2

(12) United States Patent
Haga

(10) Patent No.: US 10,635,031 B2
(45) Date of Patent: Apr. 28, 2020

(54) HEATING DEVICE AND IMAGE FORMATION DEVICE

(71) Applicant: Oki Data Corporation, Tokyo (JP)

(72) Inventor: Yasutaka Haga, Tokyo (JP)

(73) Assignee: Oki Data Corporation, Tokyo (JP)

( * ) Notice: Subject to any disclaimer, the term of this patent is extended or adjusted under 35 U.S.C. 154(b) by 540 days.

(21) Appl. No.: 15/353,785

(22) Filed: Nov. 17, 2016

(65) Prior Publication Data

US 2017/0153584 A1 Jun. 1, 2017

(30) Foreign Application Priority Data

Nov. 27, 2015 (JP) ..... 2015-231328

(51) Int. Cl.
*G03G 15/20* (2006.01)

(52) U.S. Cl.
CPC ..... *G03G 15/2039* (2013.01)

(58) Field of Classification Search
CPC ..... G03G 15/00; G03G 15/20; G03G 15/80; G03G 15/2039
USPC ..... 219/488, 482, 490, 492, 619, 649, 216, 219/660
See application file for complete search history.

(56) References Cited

U.S. PATENT DOCUMENTS 6,373,232 B1 * 4/2002 Mano ..... G03G 15/2003 219/216
6,930,293 B2 * 8/2005 Matsuo ..... H05B 6/06 219/664
7,860,414 B2 * 12/2010 Itoh ..... G03G 15/2039 399/328
8,306,448 B2 * 11/2012 Claassen ..... G03G 15/2039 399/69
8,401,417 B2 * 3/2013 Suda ..... G03G 15/80 399/88
8,614,568 B2 12/2013 Uruno et al.
(Continued)

FOREIGN PATENT DOCUMENTS

JP 2000-014193 A 1/2000
JP 2000-293059 A 10/2000
JP 2002-58292 A 2/2002
(Continued)

*Primary Examiner* — Dana Ross
*Assistant Examiner* — Ayub A Maye
(74) *Attorney, Agent, or Firm* — Metrolex IP Law Group, PLLC

(57) ABSTRACT

A heating device includes: a power unit as a primary device which supplies an alternating-current output voltage; and a secondary device including a heater which generates heat by using the alternating-current output voltage. The power unit includes: a rectifier which rectifies an alternating-current input voltage; an inverter which converts a direct-current voltage generated from an output of the rectifier to the alternating-current output voltage; a first detector which detects the alternating-current input voltage; a second detector which detects the alternating-current output voltage; and an inverter controller which receives information indicating a set voltage of an output of the inverter, and controls the inverter such that the alternating-current output voltage approaches the set voltage based on a first detection value outputted from the first detector and on a second detection value outputted from the second detector.

7 Claims, 5 Drawing Sheets

(56) References Cited

U.S. PATENT DOCUMENTS

| | | | | |
|---|---|---|---|---|
| 9,615,406 | B2 * | 4/2017 | Tabuchi | H05B 3/06 |
| 2011/0228564 | A1 | 9/2011 | Uruno et al. | |

FOREIGN PATENT DOCUMENTS

| | | | |
|---|---|---|---|
| JP | 2008-197475 | A | 8/2008 |
| JP | 2011-193705 | A | 9/2011 |

* cited by examiner

HEATING DEVICE AND IMAGE FORMATION DEVICE

CROSS REFERENCE TO RELATED APPLICATIONS

This application claims priority based on 35 USC 119 from prior Japanese Patent Application No. 2015-231328 filed on Nov. 27, 2015, entitled "HEATING DEVICE AND IMAGE FORMATION DEVICE", the entire contents of which are incorporated herein by reference.

BACKGROUND OF THE INVENTION

1. Field of the Invention

This disclosure relates to a heating device and an image formation device including the heating device.

2. Description of Related Art

An electronic device such as office equipment and a home appliance is generally provided with: a power unit (primary device) which converts an alternating-current (AC) input voltage supplied from outside to an AC output voltage, and outputs the AC output voltage; and a processing execution unit (secondary device) which executes various processes using the AC output voltage outputted from the power unit. In an image formation device which employs electrophotography, the processing execution unit (secondary device) is a print unit which forms an image of a developer on a recording medium. The print unit includes a heater (for a fuser) as a load.

Meanwhile, Japanese Patent Application Publication No. 2000-14193 (paragraphs 0015-0030, FIGS. 1 and 2) describes a drive circuit as a power unit and an electric motor as a load of the processing execution unit (secondary device). This device includes: a rectification circuit which converts an AC input voltage to a direct-current (DC) voltage; a power factor correction circuit which steps up the DC voltage according to the AC input voltage; an inverter circuit which converts the DC voltage thus stepped up to an AC output voltage; a detection circuit which detects the DC voltage thus stepped up; an inverter drive circuit; and a controller which controls the inverter drive circuit based on a detection value of the DC voltage.

SUMMARY OF THE INVENTION

However, a conventional device does not detect the AC output voltage of the inverter circuit. Thus, the drive control of the inverter circuit according to the AC output voltage is not performed. For this reason, the above conventional device can be used only at the prescribed AC input voltage (for example, alternating-current 100 [V]). In order to use the conventional device at other AC input voltages (for example, alternating-current 230 [V]), an alteration needs to be made to the processing execution unit (for example, replacement of the heater which is the load on the processing execution unit (secondary device)).

An object of an embodiment of the invention is to provide a heating device and an image formation device including the same, the heating device being capable of supplying a desired AC output voltage to a heater even when an AC input voltage supplied to a power unit is switched.

An aspect of the invention provides a heating device that includes: a power unit as a primary device which supplies an alternating-current output voltage; and a secondary device including a heater which generates heat by using the alternating-current output voltage. The power unit includes: a rectifier which rectifies an alternating-current input voltage; an inverter which converts a direct-current voltage generated from an output of the rectifier to the alternating-current output voltage; a first detector which detects the alternating-current input voltage; a second detector which detects the alternating-current output voltage; and an inverter controller which receives information indicating a set voltage of an output of the inverter, and controls the inverter such that the alternating-current output voltage approaches the set voltage based on a first detection value outputted from the first detector and on a second detection value outputted from the second detector.

According to the aspect of the invention, it is possible to supply the desired AC output voltage to the heater even when the AC input voltage supplied to the power unit is switched.

DETAILED DESCRIPTION OF EMBODIMENTS

Figure 1:
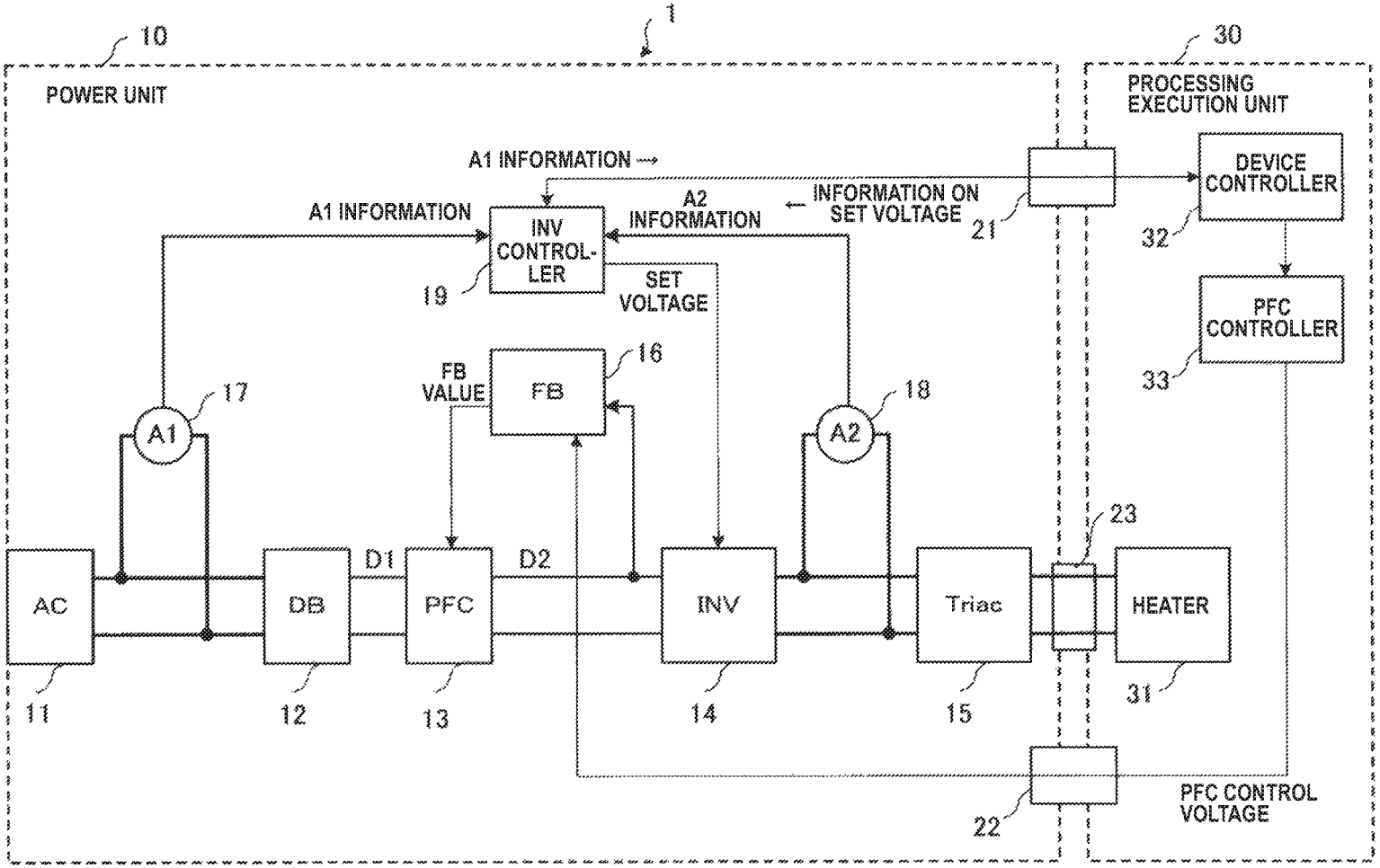
FIG. 1 is a block diagram schematically illustrating a configuration of a heating device according to Embodiment 1 of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

<<1>> Embodiment 1

<<1-1>> Configuration

FIG. 1 is a block diagram schematically illustrating a configuration of heating device 1 according to Embodiment 1 of the invention. As illustrated in FIG. 1, heating device 1 according to Embodiment 1 includes power unit 10 as a primary device, and processing execution unit 30 as a secondary device electrically connected to power unit 10 via connectors 21, 22, 23 as connectors. Although FIG. 1 illustrates power unit 10 and processing execution unit 30 as a separate configuration, power unit 10 and processing execution unit 30 can be formed on the same member. Heating device 1 is applicable to, for example, an image formation device which employs electrophotography. Description on the image formation device is provided in Embodiment 3.

As illustrated in FIG. 1, power unit 10 includes: AC input unit 11 to which alternating-current (AC) input voltage A1 is inputted; diode bridge (DB) circuit 12, which is a rectification circuit as a rectifier for rectifying AC input voltage A1; INV circuit 14 as an inverter (INV) which converts a direct-current voltage generated from an output of DB circuit 12 to an AC output voltage; AC input detector 17 as a first detector; AC output detector 18 as a second detector; and INV controller 19 such as an inverter (INV) control circuit. In addition, it is preferable that power unit 10 include: PFC circuit 13 as a power factor correction (PFC) unit which steps up output D1 of DB circuit 12 to generate DC voltage D2; and FB circuit 16 as a FB (feedback) unit which gives a FB value to PFC circuit 13. Moreover, power unit 10 may include triac 15 as a switch unit.

As illustrated in FIG. 1, processing execution unit 30 includes: heater 31 which is a heat emitter as a load; device controller 32, for example, a control circuit; and power factor correction circuit controller (PFC controller) 33 which sends a PFC control voltage to FB circuit 16. In the case where heating device 1 is applied to an image formation device, processing execution unit 30 is a print unit which forms an image on a recording medium, and heater 31 is, for example, a heater for a fuser (reference sign 150 in FIG. 4 to be described later).

One of the prescribed external AC voltages is inputted to AC input unit 11. Examples of the prescribed AC voltages are AC 100 [V] and AC 230 [V]. AC input unit 11 is, for example, a connection terminal of a power cable. The prescribed AC voltage inputted to AC input unit 11 is supplied to DB circuit 12 as AC input voltage A1.

DB circuit 12 rectifies AC input voltage A1 to output direct-current (DC) voltage D1. DB circuit 12 may be provided with a function of smoothing a rectified DC voltage. Instead, power unit 10 may be provided, at downstream of DB circuit 12, with a smoothing circuit which smoothes the rectified DC voltage.

PFC circuit 13 steps up DC voltage D1 to a target voltage, and outputs DC voltage D2 thus stepped up. FB circuit 16 gives PFC circuit 13 a feedback (FB) value according to DC voltage D2 outputted from PFC circuit 13. The target voltage is determined by a PFC control signal given from PFC controller 33. PFC circuit 13 makes an adjustment such that DC voltage D2 approaches the target voltage based on the FB value given by FB circuit 16.

INV circuit 14 converts DC voltage D2 outputted from PFC circuit 13 to AC output voltage A2. INV controller 19 controls INV circuit 14 such that AC output voltage A2 approaches a set voltage based on a detection value of AC input detector 17, which detects AC input voltage A1, and on a detection value of AC output detector 18, which detects AC output voltage A2. This set voltage is, for example, a voltage based on information on the set voltage outputted from device controller 32 of processing execution unit 30.

Triac 15 is a switch circuit to select either an ON-state where AC output voltage A2 is supplied to heater 31, or an OFF-state where AC output voltage A2 is not supplied. For example, triac 15 can select either the ON-state or OFF-state in response to a control signal from device controller 32 or an operation of the switch by the user.

INV controller 19 sends, via connector 21, information on power unit 10, such as AC input voltage A1, to device controller 32 of processing execution unit 30.

The device controller 32 sends, via connector 21, the information on the set voltage to INV controller 19 based on the received information on power unit 10. Device controller 32 controls PFC controller 33 based on the received information on power unit 10. PFC controller 33 sends, via connector 22, FB circuit 16 a control signal (PFC control voltage) indicating the target voltage of DC voltage D2 outputted from PFC circuit 13.

Note that parts (for example, the controllers) of power unit 10 and processing execution unit 30 in FIG. 1 may be implemented (for example, by using a computer) with a memory as a storage device (storage unit) which stores a program as software, and a processor as an information processing device which executes the program stored in the memory.

Figure 2:
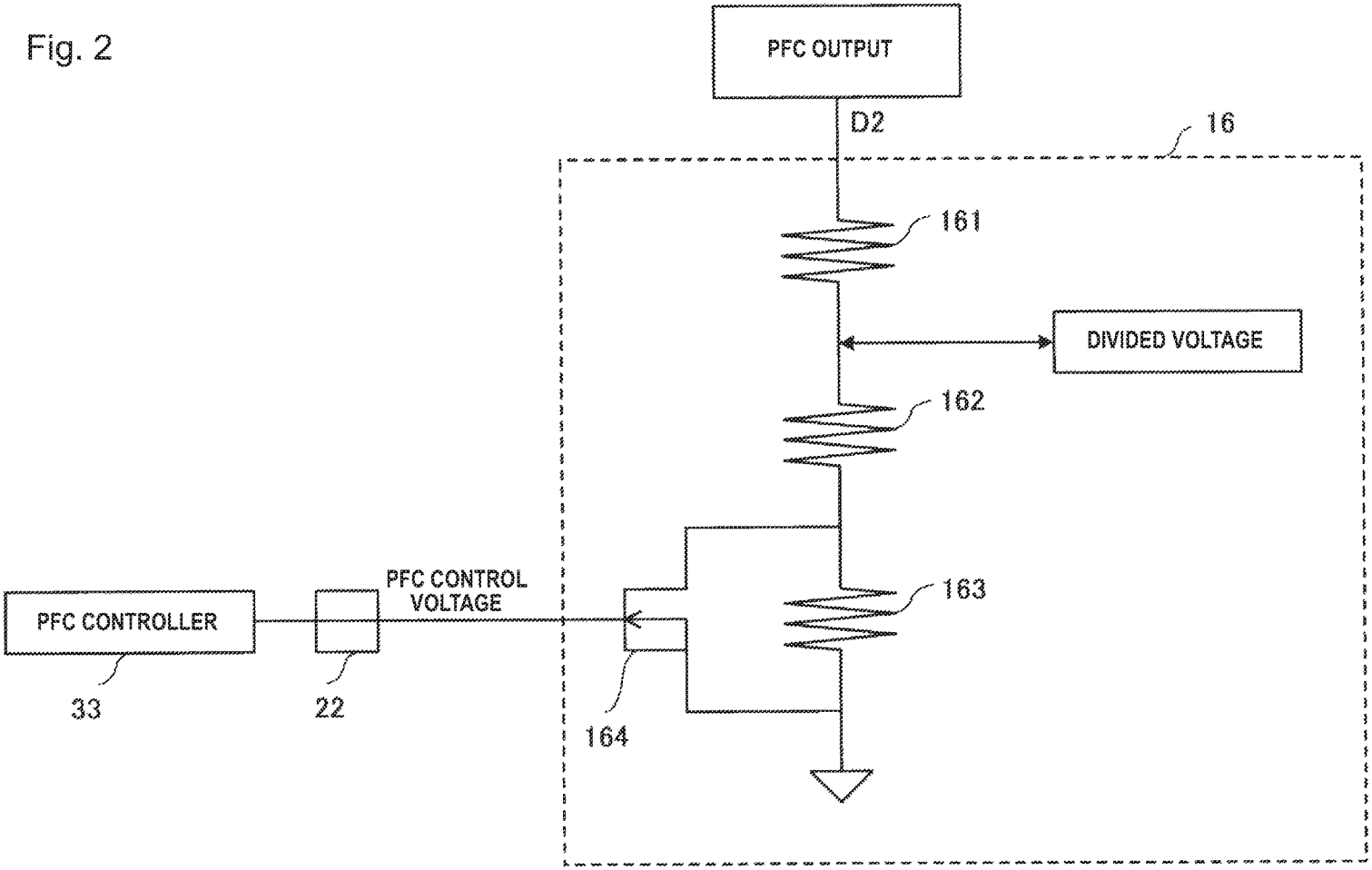
FIG. 2 is a circuit diagram illustrating an example of a feedback (FB) circuit as depicted in FIG. 1.

FIG. 2 is a circuit diagram illustrating an example of FB circuit 16 depicted in FIG. 1. FB circuit 16 includes resistors 161, 162, and 163 connected in series to one another, and field effect transistor (FET) 164 connected in parallel to resistor 163. DC voltage D2 is applied to both ends of resistors 161, 162, and 163 connected in series to one another, and a divided voltage is outputted from the junction between resistors 161 and 162. The PFC control voltage is inputted from PFC controller 33 to the gate of FET 164. It is possible to change the divided voltage by varying the control voltage applied to the gate of FET 164. The divided voltage is given to PFC 13 as the target voltage.

<<1-2>> Operation

Hereinbelow, the operation of heating device 1 according to Embodiment 1 is described. AC input voltage A1 is rectified at DB circuit 12 to become DC output voltage D1, and then is stepped up and smoothed at PFC circuit 13 to be DC output voltage D2 with a predetermined voltage (for example, DC 390 [V]).

INV circuit 14 outputs predetermined AC output voltage A2 by switching DC output voltage D2 outputted from PFC circuit 13. INV controller 19 sends information on AC input voltage A1 to device controller 32 via connector 21.

Device controller 32 instructs PFC controller 33 to vary the output voltage of PFC circuit 13 based on the information on AC input voltage A1. PFC controller 33 outputs, via connector 22, to FB circuit 16 the PFC control voltage for varying the target voltage, which is the target value of the output voltage of PFC circuit 13 on the primary side.

Meanwhile, INV controller 19 and device controller 32 include a bidirectional interface. Device controller 32 can send INV controller 19 the information on the set voltage indicating the output voltages of INV circuit 14 in a standby mode, a printing mode, and in a warm-up mode. In the case where processing execution unit 30 is an image formation device, the INV output voltage in the standby mode is 80 [V], the INV output voltage in the printing mode is 100 [V], and the INV output voltage in the warm-up mode is 120 [V], for example.

In power unit 10, no matter what value of the prescribed AC voltage is inputted as AC input voltage A1 (for example, AC 230 [V] or AC 100 [V]), AC output voltage A2, which is the set voltage, is outputted.

However, in the case (Case 1) where DC output voltage D2 of PFC circuit 13 is set to DC 390 [V], AC output voltage A2 of INV circuit 14 is set to AC 100 [V], and AC 230 [V] is applied as AC input voltage A1, the voltage margin at the voltage conversion point of PFC circuit 13 is $\Delta 65$ [V] $\approx |390-(230\times\sqrt{2})|$[V], and the voltage margin at the voltage conversion point of INV circuit 14 is $\Delta 290$ [V]$=|390|100|$ [V].

Moreover, in the case (Case 2) where DC output voltage D2 of PFC circuit 13 is set to DC 390 [V], AC output voltage A2 of INV circuit 14 is set to AC 100 [V], and AC 100 [V] is applied as AC input voltage A1, the voltage margin at the voltage conversion point of PFC circuit 13 is $\Delta 249$ [V]$\approx|390-(100\times\sqrt{2})$[V], and the voltage margin at the voltage conversion point of INV circuit 14 is $\Delta 290$ [V]$=|390-100|$[V].

The higher the driven voltage is, the more greatly the power is lost because PFC circuit 13 and INV circuit 14 transform voltages using a switching element. In the case described above (Case 2), the power loss is large. Hence, in the case where AC input voltage A1 is AC 100 [V], it is possible to reduce the loss by decreasing DC output voltage D2 of PFC circuit 13 to, for example, DC 260 [V]. In that case, the voltage margin at the voltage conversion point of PFC circuit 13 is Δ119 [V]≈|260−(100×√2)|[V], and the voltage margin at the voltage conversion point of INV circuit 14 is Δ160 [V]=|260−100|[V].

Additionally, it is possible to shorten the period of time during which the temperature of heater 31 increases to a predetermined temperature by stepping up the AC output voltage of INV circuit 14 from AC 100 [V] to AC 120 [V], in the case where heater 31 is a heater for the fuser of the image formation device and needs to be set to the predetermined temperature in a short period of time when, for example, the state of the device is in the warm-up mode.

<<1-3>> Effects

According to heating device 1 of Embodiment 1, as described above, it is possible to supply a desired AC output voltage A2 to heater 31 even when AC input voltage A1 supplied to power unit 10 is switched, because AC output voltage A2, which is an output of INV circuit 14, is set to a desired voltage based on AC input voltage A1 and AC output voltage A2. Thus, the same heater 31 can be used (a common use of the heater) in both cases where AC input voltage A1 is AC 230 [V] and AC 100 [V].

In addition, according to heating device 1 of Embodiment 1, it is possible to reduce power consumption because the power factor is improved by using PFC circuit 13.

Furthermore, according to heating device 1 of Embodiment 1, it is possible to reduce the losses at PFC circuit 13 and INV circuit 14 by changing DC output voltage D2 of PFC circuit 13 depending on AC input voltage A1.

What is more, in the case where heating device 1 is applied to the image formation device, it is possible to vary the voltage applied to heater 31 to an appropriate voltage, depending on the operating state of the device. Usability can be improved thanks to the control described above.

<<2>> Embodiment 2

Figure 3:
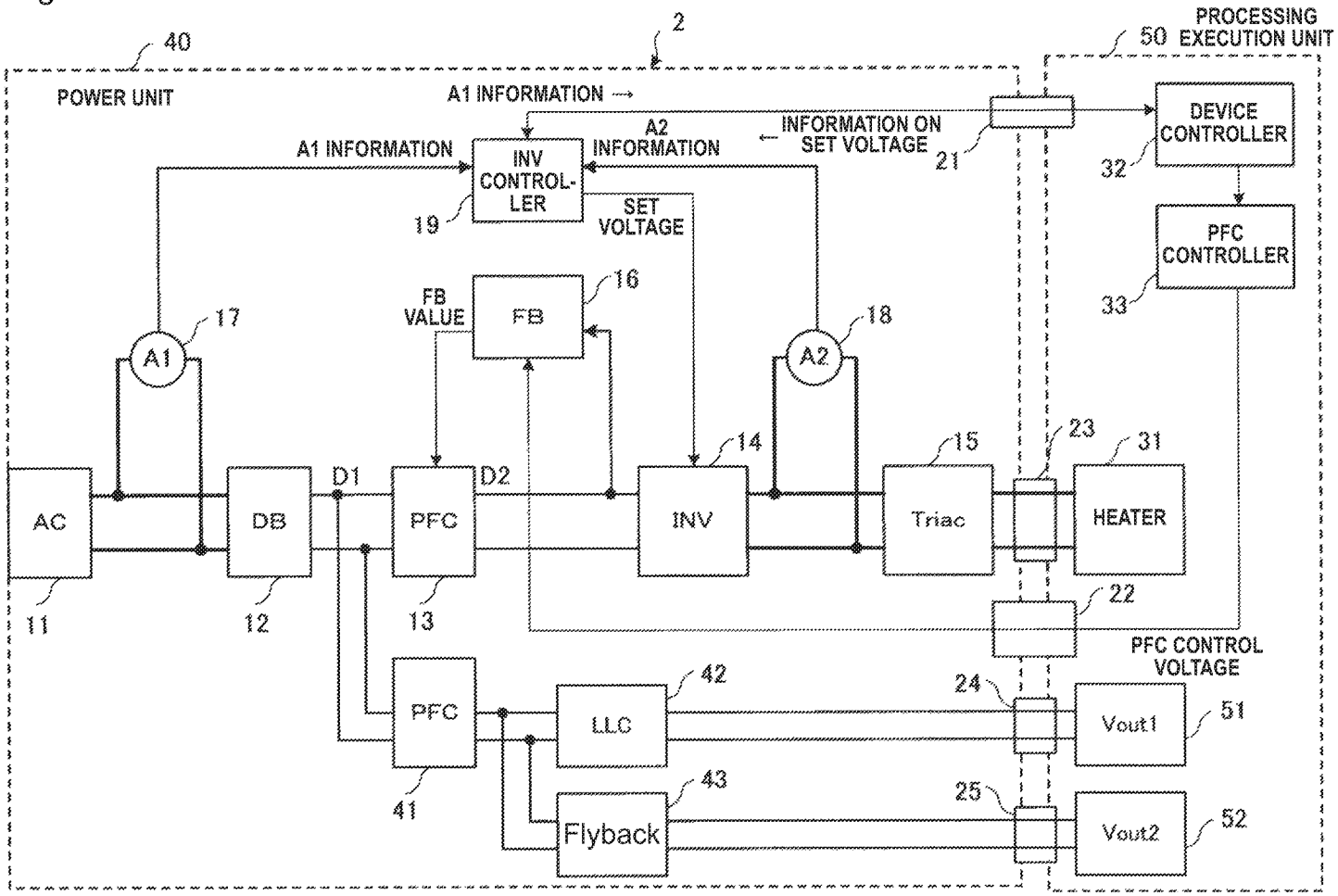
FIG. 3 a block diagram schematically illustrating a configuration of a heating device according to Embodiment 2 of the invention.

FIG. 3 a block diagram schematically illustrating a configuration of heating device 2 according to Embodiment 2 of the invention. In FIG. 3, components identical to or corresponding to the components illustrated in FIG. 1 are assigned the same reference signs as those depicted in FIG. 1. Heating device 2 according to Embodiment 2 is different from heating device 1 according to Embodiment 1 in that heating device 2 is provided, downstream of DB circuit 12, with PFC circuit 41 as another PFC unit, LLC circuit 42 as an LLC unit, and with flyback circuit 43 as a flyback unit.

The operation of heating device 2 according to Embodiment 2 is the same as that of heating device 1 according to Embodiment 1, except for the operations of PFC circuit 41, LLC circuit 42, and flyback circuit 43. Thus, in the following description, differences from Embodiment 1 are mainly explained.

In order to reduce the power loss, it is desirable that PFC circuit 13 change DC output voltage D2 depending on AC input voltage A1, as described in Embodiment 1. Note that heater 31, which serves as a load circuit, does not greatly affect the functions of processing execution unit 50 even when AC input voltage A2 applied thereto changes to some extent.

PFC circuit 41, LLC circuit 42, and flyback circuit 43 of heating device 2 according to Embodiment 2, on the other hand, supply power to a configuration which requires a stable input voltage. For this reason, PFC circuit 41 outputs a predetermined constant voltage (for example, 390 [V]) even when AC input voltage A1 is switched. A DC voltage transformed at LLC circuit 42 is supplied to load Voutl of processing execution unit 50 via connector 24, and a DC voltage transformed at flyback circuit 43 is supplied to load Vout2 of processing execution unit 50 via connector 25. As above, PFC circuit 13 switches the DC output voltage in order to reduce the power loss, but PFC circuit 41 does not vary the DC output voltage, taking into consideration the importance of the stability of the output voltage.

According to heating device 2 of Embodiment 2, PFC circuit 41 does not vary the DC output voltage even when the output of PFC circuit 13 on the INV circuit 14 side is changed depending on AC input voltage Al, as described above. For this reason, it is possible to perform a control such that a priority is placed on the improvement of the efficiency for a load (for example, heater 31) the stability of operation of which is not important, while a priority is also placed on the stability of the operation for a load (logic circuit) the stability of operation is which is important.

<<3>> Embodiment 3

<<3-1>> Configuration

Figure 4:
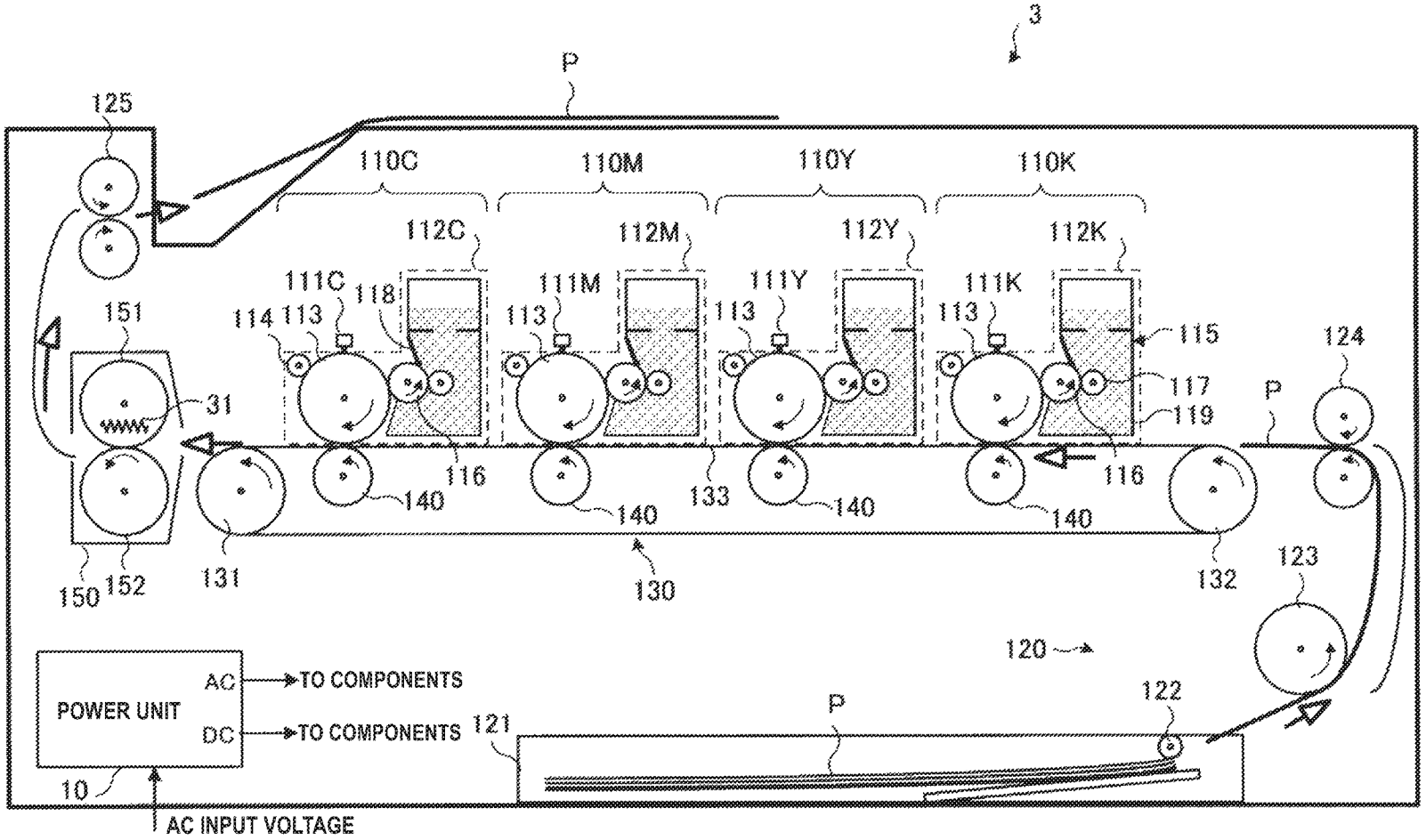
FIG. 4 is a vertical cross-sectional view schematically illustrating a configuration of an image formation device according to Embodiment 3 of the invention.

FIG. 4 is a vertical cross-sectional view schematically illustrating a configuration of image formation device 3 according to Embodiment 3 of the invention. Image formation device 3 according to Embodiment 3 is, for example, a color printer which employs electrophotography. Image formation device 3 includes either heating device 1 according to Embodiment 1 or heating device 2 according to Embodiment 2. In Embodiment 3, heater 31 of Embodiment 1 or 2 is a thermoelectric heater provided to heat roller 151 of fuser 150.

As illustrated in FIG. 4, image formation device 3 includes, as main components: image formation sections 110K, 110Y, 110M, and 110C each of which forms by electrophotography a developer image (toner image) on recording medium P, which is a sheet-shaped material such as a sheet of paper; medium supplier (sheet feeder) 120 which supplies recording medium P to image formation sections 110K, 110Y, 110M, and 110C; conveyer 130 which conveys recording medium P; transfer rollers 140 as transfer units which are disposed corresponding to respective image formation sections 110K, 110Y, 110M, and 110C; fuser 150 as a fusing device which fuses the toner images transferred onto recording medium P on recording medium P; and a pair of discharge rollers 125 as a medium discharger which discharge recording medium P having passed through fuser 150 to the outside of image formation device 3. Although FIG. 4 illustrates four image formation sections 110K, 110Y, 110M, and 110C, the number of image formation sections included in image formation device 3 may be three or less, or five or more. Also, FIG. 4 illustrates a case where image formation device 3 is a color printer. However, the invention is applicable to a monochrome printer which has one image formation section as long as the image formation device forms an image on a recording medium by electrophotography. Moreover, FIG. 4 illustrates a case where image formation device 3 is a printer. However, the invention is applicable to other devices such as a photocopier, a facsimile, and a multifunctional peripheral (MFP) as long as the image formation device forms an image on a recording medium by electrophotography.

As illustrated in FIG. 4, medium supplier 120 includes: medium cassette (sheet cassette) 121; feed roller (hopping roller) 122 which delivers recording media P loaded inside medium cassette 121 one by one; roller 123 which conveys recording medium P delivered from medium cassette 121; and a pair of rollers 124 which convey recording medium P toward image formation sections 110K, 110Y, 110M, and 110C.

Image formation sections 110K, 110Y, 110M, and 110C form a black (K) toner image, a yellow (Y) toner image, a magenta (M) toner image, and a cyan (C) toner image on recording medium P, respectively. Image formation sections 110K, 110Y, 110M, and 110C are arranged along a medium conveyance path in a medium conveyance direction (direction of the arrows) from the upstream side to the downstream side. Image formation sections 110K, 110Y, 110M, and 110C include respective image formation units 112K, 112Y, 112M, and 112C detachably formed for the colors. Image formation units 112K, 112Y, 112M, and 112C arranged in series are provided corresponding to the respective colors of image formation sections 110K, 110Y, 110M, and 110C. That is, image formation unit 112C forms an image using cyan toner, image formation unit 112M forms an image using magenta toner, image formation unit 112Y forms an image using yellow toner, and image formation unit 112K forms an image using black toner. Image formation units 112K, 112Y, 112M, and 112C basically have the same structure except that the colors of the toner are different from one another.

Image formation sections 110K, 110Y, 110M, and 110C include optical exposure units 111K, 111Y, 111M, and 111C, respectively, as exposure devices for their relevant colors.

Each of image formation units 112K, 112Y, 112M, and 112C includes: photoconductor drum 113 as an image carrier which is rotatably supported with the center axis of rotation as the center; charge roller 114 as a charge member which uniformly charges a surface of photoconductor drum 113; development device 115 which forms an electrostatic latent image on the surface of photoconductor drum 113 by exposure to light performed by an optical exposure unit (one of 111K, 111Y, 111M, and 111C), and thereafter supplies toner onto the surface of photoconductor drum 113 to form a toner image corresponding to the electrostatic latent image; and cleaning blade 119*a* (FIG. 5) as a cleaning member.

Figure 5:
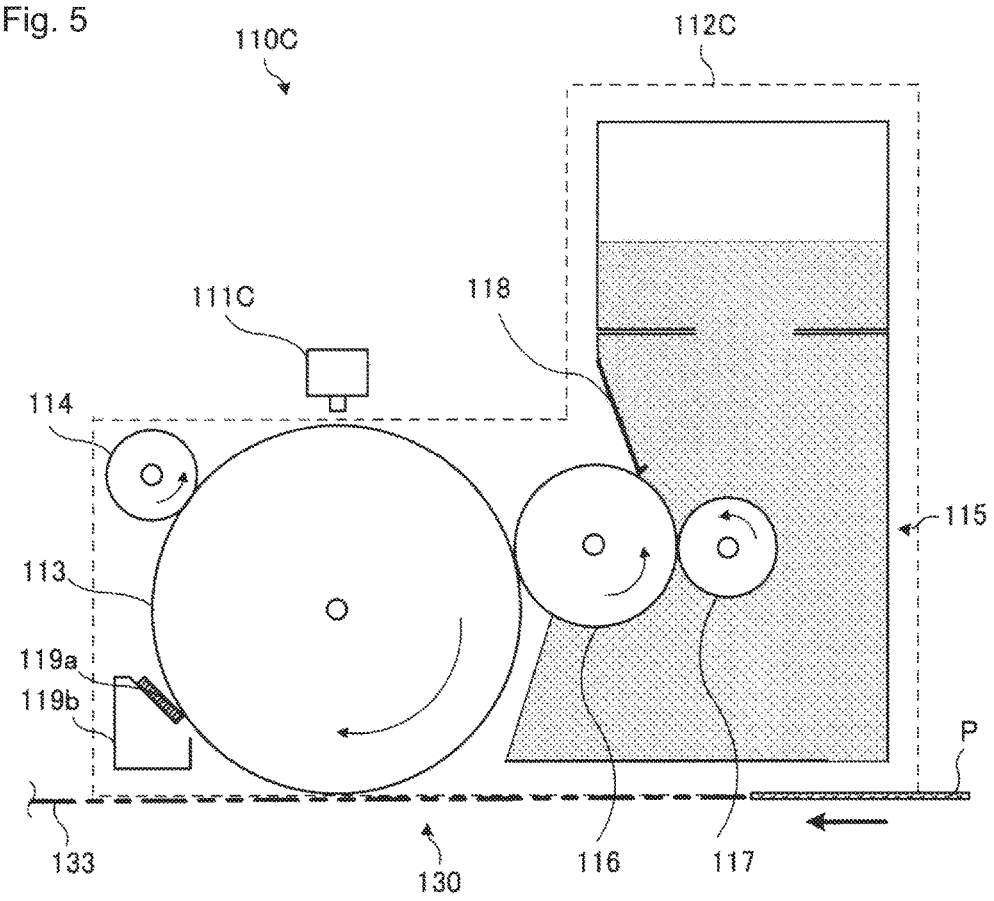
FIG. 5 is a vertical cross-sectional view schematically illustrating a configuration of an image formation section as depicted in FIG. 4.

FIG. 5 is a vertical cross-sectional view schematically illustrating a configuration of image formation section 110C depicted in FIG. 4. Image formation sections 110M, 110Y, and 110K have the same structure as that of image formation section 110C. As illustrated in FIG. 5, cleaning blade 119*a* scrapes off remaining matters, such as toner remaining on the surface of rotating photoconductor drum 113 and an external additive having come off of the toner, and thereby collects the remaining matters into collection box 119*b*.

As illustrated in FIG. 5, development device 115 includes: a toner storage unit as a developer storage unit which defines a developer storage space to store toner; development roller 116 as a developer carrier which supplies toner onto the surface of photoconductor drum 113; supply roller 117 which supplies toner stored inside the toner storage unit to development roller 116; and development blade 118 as a toner regulation member which regulates a thickness of a toner layer on a surface of development roller 116.

Optical exposure units 111K, 111Y, 111M, and 111C each expose the uniformly charged surface of photoconductor drum 113 to light based on image data for printing. Each of optical exposure units 111K, 111Y, 111M, and 111C is an LED (light-emitting diode) head including an LED array in which LED elements are arranged in a direction of the axis line of photoconductor drum 113. Note that a laser scanning unit including a laser emitter and a polygonal mirror (rotating multi-surface mirror for scanning) may be employed as an optical exposure unit.

As illustrated in FIG. 4, conveyer 130 includes: conveyer belt (transfer belt) 133 which electrostatically attracts and conveys recording medium P; drive roller 131 which is rotated by a drive unit to drive conveyer belt 133; and tension roller (driven roller) 132 which forms a pair together with drive roller 131 and stretches conveyer belt 133.

As illustrated in FIG. 4, transfer rollers 140 are disposed opposite to respective photoconductor drums 113 of image formation units 112K, 112Y, 112M, and 112C with conveyer belt 133 interposed therebetween. Transfer rollers 140 transfer in sequence developer images (toner images) formed on the respective surfaces of photoconductor drums 113 of image formation units 112K, 112Y, 112M, and 112C onto an upper surface of recording medium P being conveyed in the direction of the arrows along the medium conveyance path. Then, a color image is formed of toner images overlaid.

Fuser 150 includes a pair of rollers 151 and 152 in pressure contact with each other. Roller 151 is a heat roller with a built-in heater for heating (heater 31 in Embodiment 1 or 2), while roller 152 is a press roller which is pressed to roller 151. Recording medium P including a developer image (toner image) unfused thereto passes through between the pair of rollers 151 and 152 of fuser 150. At this time, the unfused toner image is heated and pressed and then is fused on recording medium P.

<<3-2>> Operation

Subsequently, the operation of forming an image by image formation section 110C of image formation device 3 according to Embodiment 3 is described with reference to FIG. 5. First, the surface of photoconductor drum 113 is charged to approximately −600 [V] by charge roller 114 to which a negative voltage is applied. Light corresponding to an image to be printed is applied to photoconductor drum 113 from exposure head (LED head) 111C, thereby forming an electrostatic latent image on photoconductor drum 113. At this time, a region of the surface of photoconductor drum 113 to which the light has been applied is raised to a potential of approximately −50 [V]. The toner inside the toner storage unit is negatively charged due to friction between development roller 116 to which a voltage of approximately −300 [V] is applied and supply roller 117 to which a voltage of approximately −450 [V] is applied. Then, the toner is supplied to development roller 116 by a force resulting from a difference in potential between development roller 116 and supply roller 117 and by a physical force of the conveyance of the rollers. After the thickness of the toner layer is adjusted by development blade 118, the toner is brought into contact with photoconductor drum 113. The toner brought into contact with photoconductor drum 113 receives a force of an electric field generated due to a difference between a potential of photoconductor drum 113 and a potential of development roller 116. In the region exposed to light, the toner moves to photoconductor drum 113, while in a region not exposed to light, the toner remains on development roller 116. As above, the development is performed to change the electrostatic latent image to a visible image.

<<3-3>> Effects

As has been described above, according to image formation device 3 of Embodiment 3, it is possible to supply a desired AC output voltage A2 to heater 31 even when AC input voltage A1 supplied to power unit 10 is switched. Thus, identical heaters 31 can be used (a sharing of the heater) in both of the cases where AC input voltage A1 is AC 230 [V] and AC 100 [V].

In addition, according to image formation device 3 of Embodiment 3, it is possible to reduce the power consumption because heating device 1 of Embodiment 1 or heating device 2 of Embodiment 2 is applied thereto.

Furthermore, it is possible to reduce the losses at PFC circuit 13 and INV circuit 14 by changing DC output voltage D2 of PFC circuit 13 depending on AC input voltage A1.

What is more, according to image formation device 3 of Embodiment 3, it is possible to vary the voltage applied to heater 31 to an appropriate voltage, depending on the operating state of the device. Accordingly, usability can be improved thanks to the control described above.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A heating device comprising:

a power unit as a primary device which supplies an alternating-current output voltage; and a secondary device comprising a print unit including a heater which generates heat by using the alternating-current output voltage, wherein the power unit includes a rectifier which rectifies an alternating-current input voltage, an inverter which converts a direct-current voltage generated from an output of the rectifier to the alternating-current output voltage, a first detector which detects the alternating-current input voltage, a second detector which detects the alternating-current output voltage, an inverter controller which receives information indicating a set voltage of an output of the inverter, and controls the inverter such that the alternating-current output voltage approaches the set voltage based on a first detection value outputted from the first detector and on a second detection value outputted from the second detector, a first power factor correction unit which steps up the output of the rectifier and thereby outputs the direct-current voltage to the inverter, a second power factor correction unit which steps up the output of the rectifier and thereby outputs another direct-current voltage, and a converter which converts said another direct-current voltage outputted from the second power factor correction unit to a direct-current output voltage to be supplied to the secondary device.

2. The heating device according to claim 1, wherein the secondary device further includes a device controller which outputs information indicating an operating state of the secondary device, and the inverter controller varies the set voltage depending on the information indicating the operating state.

3. The heating device according to claim 1, wherein the inverter converts the direct-current voltage, which is outputted from the first power factor correction unit, to the alternating-current output voltage.

4. The heating device according to claim 1, wherein the power unit further includes a feedback unit which gives the first power factor correction unit a feedback value according to the direct-current voltage outputted from the first power factor correction unit, and the first power factor correction unit adjusts the direct-current voltage based on the feedback value.

5. The heating device according to claim 1, wherein the converter includes at least one of an LLC circuit and a flyback circuit.

6. An image formation device comprising the heating device according to claim 1, wherein the print unit is configured to form an image of a developer on a recording medium.

7. The heating device according to claim 4, wherein the secondary device further includes a power factor controller which sends the feedback unit a control signal to control a target voltage of the first power factor correction unit.

* * * * *